United States Patent [19]

Holmes

[11] 4,238,913

[45] Dec. 16, 1980

[54] BULKHEAD STRUCTURE

[75] Inventor: Ronald Holmes, Stoney Brook, N.Y.

[73] Assignee: Advanced Structures Corp., Deer Park, N.Y.

[21] Appl. No.: 942,483

[22] Filed: Sep. 15, 1978

[51] Int. Cl.[3] ..... B63B 3/56; E04B 2/00

[52] U.S. Cl. ..... 52/238; 52/393; 52/403; 114/116

[58] Field of Search ..... 52/238, 241, 242, 243, 52/274, 278, 279, 393, 399, 402, 403, 455, 457, 474, 475, 515, 516, 580, 582, 589; 114/116

[56] References Cited

U.S. PATENT DOCUMENTS

| | | | |
|---|---|---|---|
| 2,333,289 | 11/1943 | Bohnsack | 114/116 X |
| 3,274,741 | 9/1966 | Neagle | 52/242 |
| 3,535,842 | 10/1970 | Karn | 52/241 |
| 3,913,292 | 10/1975 | Braekkan | 52/241 X |
| 4,038,799 | 8/1977 | Shanks | 52/241 |
| 4,109,430 | 8/1978 | Fuller | 52/241 |
| 4,163,348 | 8/1979 | Thomas | 52/241 |

FOREIGN PATENT DOCUMENTS

| | | | |
|---|---|---|---|
| 612720 | 1/1961 | Canada | 52/393 |
| 1122504 | 5/1956 | France | 52/393 |
| 1042038 | 9/1966 | United Kingdom | 49/DIG. 1 |

*Primary Examiner*—J. Karl Bell

*Attorney, Agent, or Firm*—Stephen E. Feldman; Marvin Feldman

[57] ABSTRACT

A bulkhead construction for partitioning a deck comprises a lower panel member having an L-shaped portion affixed to the deck. An upper panel member has an L-shaped portion interfitting in the L-shaped portion of the lower panel whereby the upper panel member is supported by the lower panel member. A plate element for affixing the panel members to each other is fastened to the upper and lower panel members. A second embodiment of the invention comprises the lower panel member being constituted of a first metal. A base member constituted of a second metal is affixed to the deck for receiving the lower panel member. Polymeric material is disposed between the panel member and the base member to prevent contact of the first and second metals in order that corrosion is substantially prevented.

8 Claims, 4 Drawing Figures

BULKHEAD STRUCTURE

BACKGROUND OF THE INVENTION

While the invention is subject to a wide range of applications, it is especially related to bulkhead structures for ships and specifically to panel-type construction and will be particularly described in that connection.

In the bulkhead structure art, it is known to provide aluminum honeycomb construction panels mounted within "U" channels directly to the decks of a ship. Such construction, while providing the desired lightweight strength, often resulted in corrosion due to the dissimilar aluminum to steel metal construction in the presence of sea water. In addition, an open base member which received and supported the construction panels, trapped water and thereby increased the problems of corrosion. Further, it was not possible to pre-assemble bulkhead members for at least several reasons. When open U-shaped base members were used to support the bulkhead panels, it was often difficult to obtain the precise alignment required when the base members were welded to the deck. Also, erecting split H-shaped or H-shaped plates between bulkhead panels to allow for disassembly could not be accomplished until the bulkhead panels were installed.

Panel constructions of various types have been proposed in different types of construction operations. Exemplary of such prior art constructions are U.S. Pat. No. 3,337,756 to Polhamus; U.S. Pat. No. 3,830,027 to Paisley; U.S. Pat. No. 4,051,641 to Elliott; U.S. Pat. No. 3,983,670 to Lightfoot; U.S. Pat. No. 3,913,292 to Braekkan; and U.S. Pat. No. 2,048,153 to Wollaeger.

It is an object of the present invention to provide a bulkhead structure wherein the base member and bulkhead panel of dissimilar metals are bound together by a polymeric material to substantially prevent corrosion.

It is an object of the present invention to provide a bulkhead structure wherein the bulkhead panels may be initially installed with the bulkhead plate members being installed at a later date.

It is a further object of the present invention to provide a closed base member for use with a bulkhead panel.

It is a further object of the present invention to provide a bulkhead structure which is relatively easy to assemble and disassemble.

It is a further object of the present invention to provide a bulkhead structure which is relatively inexpensive to manufacture and erect.

SUMMARY OF THE INVENTION

In accordance with the present invention, there is disclosed a bulkhead structure for partitioning a deck comprising a lower panel member having an L-shaped portion affixed to the deck. An upper panel member has an L-shaped portion interfitting in the L-shaped portion of the lower panel member. A plate element for affixing the panel members to each other is fastened to the overhead structure of the ship and lower panel members. A second embodiment of the present invention includes a bulkhead panel constituted of a first metal. A base member constituted of a second metal is affixed to the deck for receiving the bulkhead panel. Polymeric material is disposed between the panel and the base member to prevent contact of the first and second metals in order to substantially prevent corrosion.

For a better understanding of the present invention, together with other and further objects thereof, references is made to the following description, taken in connection with the accompanying drawings, while its scope will be pointed out in the appended claims.

DESCRIPTION OF THE PREFERRED EMBODIMENT

Figure 2:
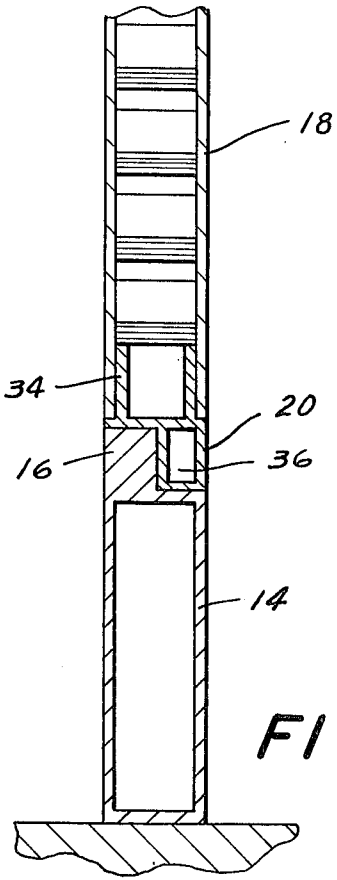
FIG. 2 is a view taken on Line 2—2 FIG. 1.

In accordance with the present invention, a lower panel member 14 having an L-shaped portion 16 is affixed to a deck 12. An upper panel member 18 has an L-shaped portion interfitting in the L-shaped portion 16 of the lower panel member 14 whereby the upper panel member is supported by the lower panel member. A plate element 22 for affixing the panel members 14 and 18 to each other is fastened to an overhead structure 23 (a section of metal attached to the ceiling structure of the ship), and to the lower panel members. A second embodiment includes a bulkhead panel 62 being constituted of a first metal. A base member 68 constituted of a second metal is affixed to the deck for receiving the bulkhead panel. Polymeric material 70 is disposed between the panel and the base member to prevent contact of the first and second metals in order to substantially prevent corrosion.

Figure 1:
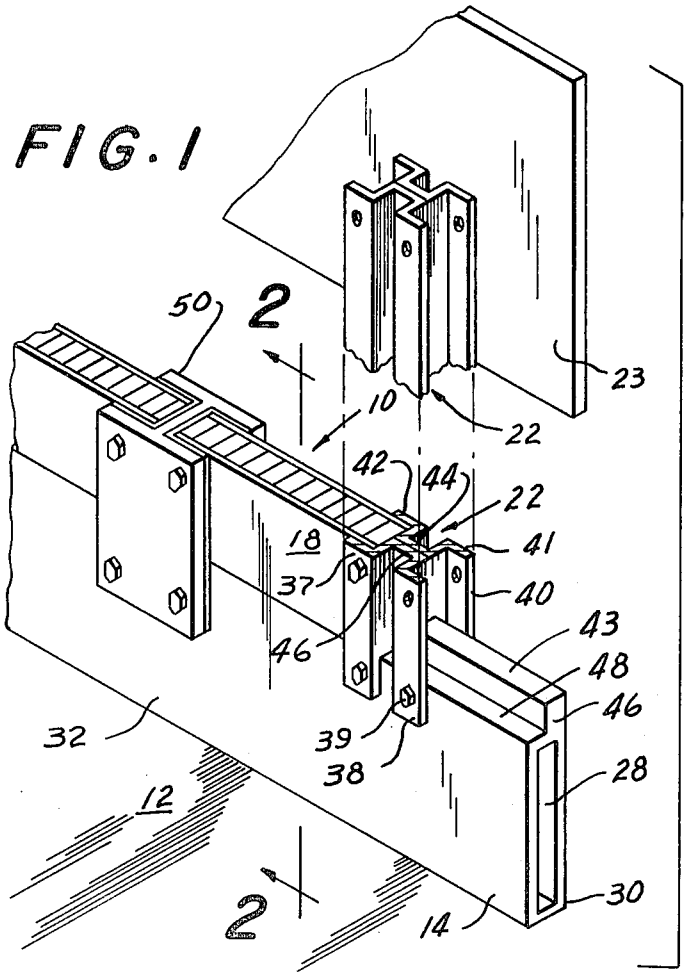
FIG. 1 is an illustration of a bulkhead structure with a plate affixing the upper and lower panels in accordance with the present invention.
Figure 4:
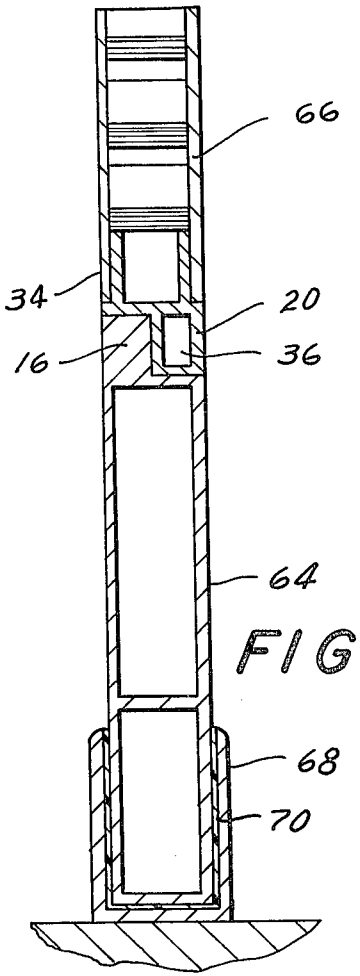
FIG. 4 is a view taken on Line 4—4 of FIG. 3.

Referring to FIG. 1, there is illustrated a bulkhead structure 10 for partitioning a deck 12. A lower panel member 14 has an L-shaped portion 16 and is affixed to the deck 12 by any suitable means, such as, for example, welding. The panel member 14 has a hollow cross-section 28 which may be of any desirable shape such as, for example, a rectangle, as shown. The member 14 includes an L-shaped portion 16 and is completely closed with the exception of ends 30.

An upper panel member 18, as best seen in FIG. 2, has an L-shaped portion 20 affixed thereto. Member 18 is constructed of an aluminum honeycombed panel in order to reduce the weight and still provide strength. However, it is within the scope of the present invention to use a panel of any desirable material and construction. The bottom portion 34 of panel 18 is provided with an L-shaped portion 20 which may be affixed to the panel member by any suitable means, such as, for example, welding. The L-shaped portion is completely closed along its length and may have a hollow cross-section of any desirable shape, such as, for example, a rectangular as shown. This L-shaped portion 20 interfits with the L-shaped portion 16 of the lower panel member in order that the upper panel member 18 is supported by the lower panel member 14.

A plate member 22 affixes the panel members to each other by being fastened at one end 37 to the upper member and at the other end 38 to the lower panel member whereby the L-shaped interfit is bridged. The fastening may be by any desirable means such as, for example, bolts 39. The plate member may be of different types such as a split H post 40, as shown. Post 40 is constructed of two U-shaped sides 41 and 42 which are joined by two connecting walls 44 and 46. The side of the H-post adjoined to the wall 44 is shaped in order that it will accommodate wall 43 of the L-shaped portion 16 while the side of the H-post adjoined to the connecting wall 46 is shaped to accommodate the lower wall 48 on panel member 14. The plate element 22 may be a solid H post 50 which is used in conjunction with a split H-post, as will be explained.

In constructing a bulkhead structure 10, a lower panel member 14 is first affixed to the deck 12 by any means such as welding. Since this member is closed, no water can enter into it except through the ends 30 which may be closed or sealed in any desirable manner such as abutting them against another bulkhead. Next, an upper panel member 18 can be installed on the lower panel member by interfitting the L-shaped portions 16 and 20 as seen in FIG. 2.

Another feature of this invention is that the lower panel members can be preassembled, such as for example, by placing lower panel 62 in place between corner sections 63 and 65 and even by assembling the split and solid H sections, then the upper panels can be placed in position at a subsequent time. This permits the major part of the structure to be assembled in advance and properly positioned. Previously this could not be done because the corner members and the H sections were supported by the upper panel (there was no lower panel), and since the upper panels were not present, the corner members and H sections could not support themselves, therefore preassembly was not possible. Because of this the honeycomb panels had to be installed during the initial stages of construction. The panels therefore were often damaged because they were exposed during the remainder of the construction of the object (i.e. a ship).

The lower panel member 14 may actually be only 4 or 5 inches high, however, the invention is not limited to this dimension. The upper panel member 18 may extend to a ceiling above the deck 12. It can now be understood that the split H-post installed between every other set of wall panels is desirable in order that a panel can be removed as required. Thus, if a repair or the like behind a wall member such as 18 is necessary, one half of the split H-post 40 may be removed and thereby permit the removal of wall 18 from the solid H-post 50.

In addition, not that the closed lower panel member 14 can be sealed at the ends as explained above. Then water will not collect in any part of the bulkhead structure and thereby corrosion problems are substantially reduced.

Figure 3:
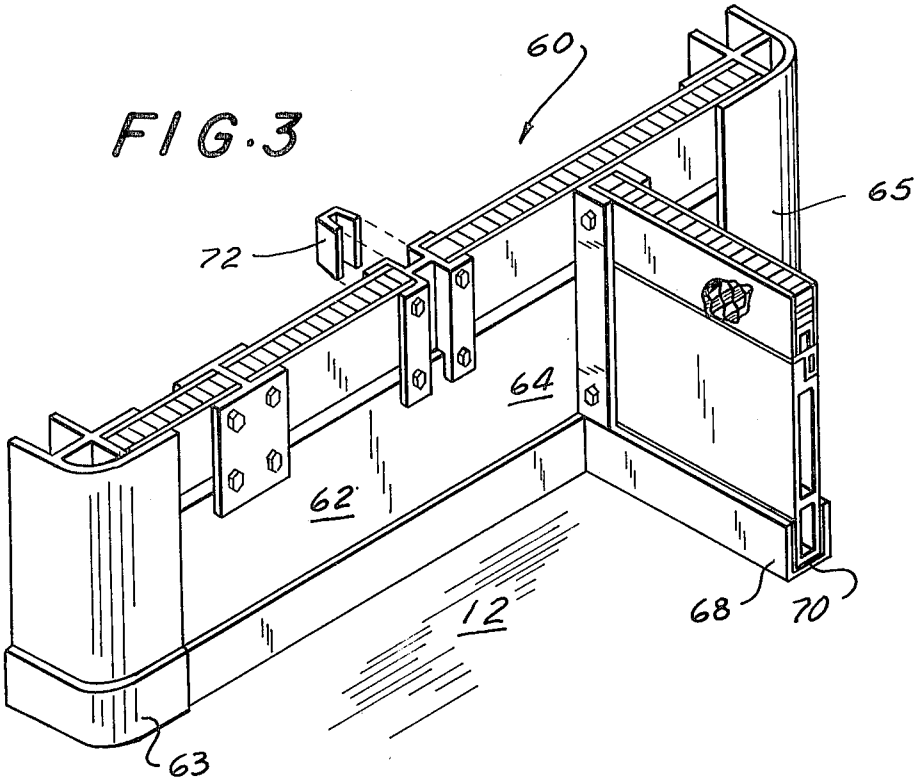
FIG. 3 is an illustration of bulkhead structure wherein a panel member is received in a base member.

Referring to FIG. 3, a second embodiment of a bulkhead structure 60 is illustrated. A bulkhead panel element 62 is constituted of a first metal such as, for example, aluminum. Also, this bulkhead panel element 62 may be comprised of two portions, a lower panel member 64 and an upper panel member 66. As explained in the first embodiment, these panels are frequently made of aluminum. The upper panel 66 may be honeycombed in order to achieve weight reduction while maintaining strength. The entire bulkhead panel 62 is supported by a U-shaped base member 68 which may be constituted of a second metal such as, for example, steel. The base member is affixed to a deck 12 by any suitable means such as, for example welding. The U-shaped member 68 receives bulkhead panel element 62 and a polymeric material, such as, for example, epoxy, secures the two together. This polymeric material 70 is disposed between element 62 and member 68 in order to prevent contact between the first and second metals and thereby substantially prevents corrosion. If the aluminum metal was in direct contact with the steel base member and/or deck, a galvanic action caused by sea water in contact with the different metals would lead to serious corrosion problems.

One skilled in the art will realize that there had been disclosed a bulkhead structure that prevents corrosion, simplifies construction and disassembly, and is relatively inexpensive to manufacture.

While there has been described what is at present considered a preferred embodiment of the invention, it will be obvious to those skilled in the art that various changes and modifications may be made therein without departing from the invention, and it is, therefore, aimed in the appended claims to cover all such changes and modifications as followed in the true spirit and scope of the invention.

What is claimed is:

1. A bulkhead structure for partitioning a ship deck comprising a bulkhead panel means being constituted of a first metal comprising aluminum, a base member comprising a U-shaped channel constituted of a second metal comprising steel permanently affixed to said deck for receiving said panel means adjacent the deck surface, corrosion prevention means comprising a polymeric material disposed between said panel means and said base member to prevent contact of said first and second metals, and further characterized in that said panel means comprises a lower panel having a first end affixedly received in said base member, and an upper panel of honeycombed construction and further comprising means to disconnectably interconnect said upper and lower panels, so that said upper panel can be removed with said lower panel remaining in said channel.

2. The bulkhead structure defined in claim 1 further characterized in that means to interconnect said panels comprises interfitting L-shaped portions of said respective panels.

3. The bulkhead structure as defined in claim 2 further characterized in that said means to interconnect further comprises a plate fastened at one end to one panel and at the other end to an overhead supporting structure and bridging the L-shaped interfit.

4. A bulkhead structure for partitioning a ship deck comprising a lower panel member having an L-shaped portion affixed to said deck, an upper panel member having an L-shaped portion interfitting in said L-shaped portion of said lower panel whereby said upper panel member is supported by said lower panel member, plate means for disconnectably connecting the panel members to each other and overhead structure and being fastened to said upper and lower panel member and bridging the L-shaped interfit, whereby said upper panel is removable with the lower panel remaining affixed to the deck.

5. The bulkhead structure as defined in claim 4 further characterized in that said lower panel member has hollow cross section and further is open only on the ends of said member.

6. The bulkhead structure as defined in claim 5 further characterized in that said upper panel member is honeycombed in construction.

7. The bulkhead structure as defined in claim 6 further characterized in that said plate means is a split H-post comprising two U-shaped sides joined by two connecting walls, each of said U-shaped sides receive a side of an upper panel member whereby half of said H-post can be removed to facilitate diassembly of said upper and lower members.

8. The bulkhead structure as defined in claim 4 further characterized in that said lower panel members comprise means to be assembled initially and permanently to said deck and wherein said upper panel members are subsequently connected thereto.

* * * * *